US005804800A

United States Patent [19]

Lee et al.

[11] Patent Number: 5,804,800

[45] Date of Patent: Sep. 8, 1998

[54] TURN TABLE DRIVING APPARATUS OF MICROWAVE OVEN

[75] Inventors: Eung-Sup Lee; Suk-Jin Han, both of Suwon, Rep. of Korea

[73] Assignee: Samsung Electronics Co., Ltd., Suwon, Rep. of Korea

[21] Appl. No.: 794,343

[22] Filed: Feb. 3, 1997

Related U.S. Application Data

[63] Continuation-in-part of Ser. No. 704,903, Aug. 30, 1996, abandoned.

[30] Foreign Application Priority Data

| | | | |
|---|---|---|---|
| Aug. 31, 1995 | [KR] | Rep. of Korea | 1995-23596 |
| Oct. 5, 1995 | [KR] | Rep. of Korea | 95-27841 |
| Mar. 28, 1996 | [KR] | Rep. of Korea | 95-8920 |
| Apr. 19, 1996 | [KR] | Rep. of Korea | 1996-12030 |

[51] Int. Cl.[6] ..... H05B 6/78

[52] U.S. Cl. ..... 219/753; 219/754; 219/762

[58] Field of Search ..... 219/753, 752, 219/754, 755, 762; 108/20, 139, 138; 99/443 R, DIG. 14; 126/338

[56] References Cited

U.S. PATENT DOCUMENTS

| | | | |
|---|---|---|---|
| 4,725,703 | 2/1988 | Park | 219/753 |
| 4,742,202 | 5/1988 | Campbell et al. | 219/753 |
| 5,315,086 | 5/1994 | Pressouyre | 219/753 |
| 5,667,714 | 9/1997 | Cho | 219/753 |
| 5,672,291 | 9/1997 | Han | 219/753 |

FOREIGN PATENT DOCUMENTS

| | | |
|---|---|---|
| 1 092 484 | 11/1967 | United Kingdom . |
| 2 205 144 | 11/1988 | United Kingdom . |

OTHER PUBLICATIONS

WPI Abstract No. 96–148636/15 & JP 08037087 (Sharp) Jun. 2, 1996.

*Primary Examiner*—Philip H. Leung
*Attorney, Agent, or Firm*—Burns, Doane, Swecker & Mathis, L.L.P.

[57] ABSTRACT

A microwave oven includes a cooking chamber in which a turn table is disposed for rotation about a vertical axis, and vertical up/down movement along the axis. The turn table has an axle extending downwardly therefrom along the axis. The lower end of the axle rests on a cam surface of a rotary cam member whereby the cam surface causes the axle (and thus the turn table) to alternately move up and down when the rotary cam member is rotated by a first motor. A second motor is connected to the axle to simultaneously rotate the axle and turn table. A traction member is fixed to the rotary cam and overlies a portion of the axle. The traction member extends along a portion of the cam surface which causes the axle to move downwardly, whereby the traction member can pull the axle downwardly if the axle does not properly gravitate downwardly.

14 Claims, 10 Drawing Sheets

FIG. 5
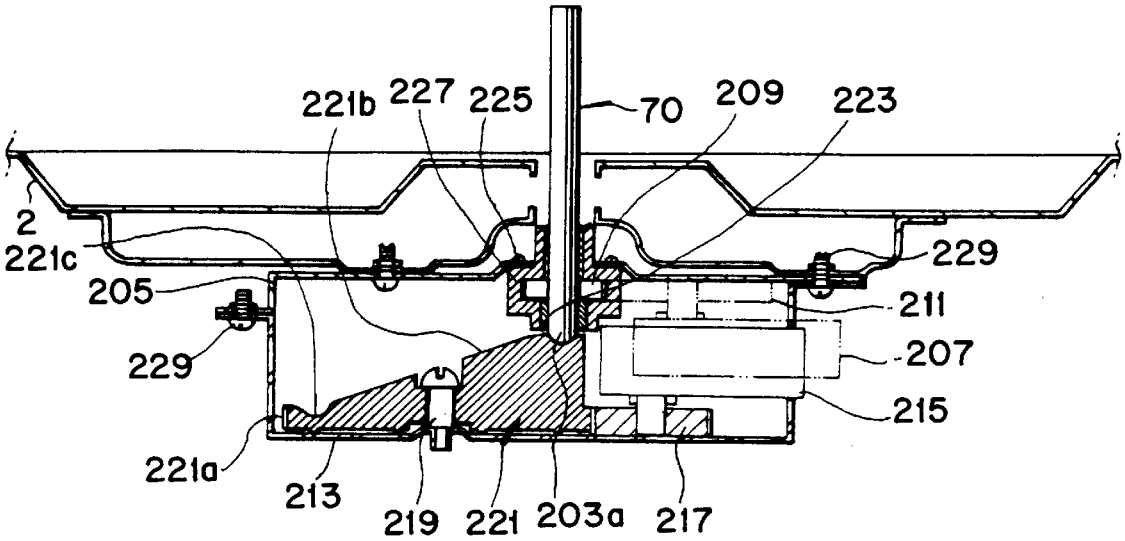
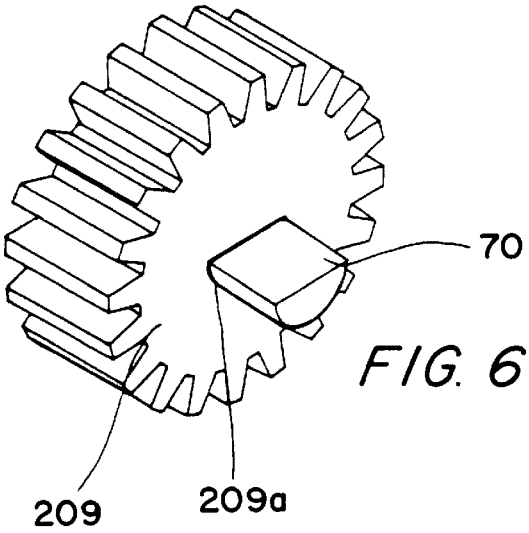
FIG. 6

TURN TABLE DRIVING APPARATUS OF MICROWAVE OVEN

RELATED INVENTION

This is a Continuation-in-Part of U.S. Ser. No. 08/704,903 filed Aug. 30, 1996.

BACKGROUND OF THE INVENTION

1. Field of the Invention

The present invention relates to a turn table driving apparatus of a microwave oven and more particularly to a turn table driving apparatus of a microwave oven for rotating and vertically moving a turn table to thereby enable more uniform and quicker cooking of food.

2. Description of the Prior Art

Generally, a microwave oven is formed, as illustrated in FIG. 1, with a cooking or heating chamber 2.

The heating chamber 2 is provided at an upper area thereof with a stirrer blade 5 rotatively mounted in a stirrer cover 3 by an axis 4 in order to disperse high frequency and to uniformly heat the food accommodated in the heating chamber 2.

The stirrer blade 5 is provided at an upper side thereof with a wave guide 6 so that the high frequency can be dispersed by the stirrer blade 5 to thereafter be guided into the heating chamber 2.

The wave guide 6 is provided at one end thereof with a magnetron 7 which serves to receive high voltage power from power source means (not shown) to thereby generate high frequency, and the case cover 1 is provided at one side thereof with a cooling fan 8 to cool the magnetron 7 and for rotating the stirrer blade 5.

The heating chamber 2 is provided at an inner floor thereof with a turn table 9. A driving means 10 is provided to rotate the turn table 9.

In the conventional microwave oven thus constructed, when the cooking plate for holding the food to be cooked is placed on the turn table 9 disposed in the heating chamber 2 and a manipulating switch (not shown) is turned on, the magnetron 7, having received the high voltage power source, is oscillated to thereby generate high frequency, which is guided into the stirrer cover 3 along the wave guide 6.

At this time, the stirrer blade 5 is rotated or driven by the blowing power of the cooling fan 8, and serves to uniformly disperse the high frequency hitting a body thereof and supply same into the heating chamber 2, so that the food on the turn table 9 can be dielectrically heated.

At the same time, the turn table 9 is rotated by the driving means 10, so that the food on the turn table 9 can be evenly irradiated by the high frequency to thereby enable the food to be dielectrically heated more quickly.

However, there is a problem in a turn table driving apparatus of a conventional microwave oven thus constructed in that, although there is a need to adjust a position of the food inserted into the heating chamber 2 to a predetermined height of the heating chamber 2 in order to utilize space in the heating chamber 2 and to effectively cook the food, the turn table 9 in the present construction only receives driving force from the driving means 10 to thereby be rotated and cannot perform vertical movement to meet the need.

As a way to solve the aforementioned problem, Japanese laid open utility model application No. Hei 1-150396 is disclosed, where a turn table driving apparatus of a microwave oven, as illustrated in FIG. 2, includes turn table rotary means 20 for rotating the turn table 9 and turn table vertical moving means 30 for vertically moving the turn table 9 by way of a linkage.

A first motor 21 is fixedly mounted at an upper side thereof to a driving coupling 22 which is keyed to a driven coupling 23 protruding downward into a central bottom area of the turn table 9 and disposed to penetrate through a bottom floor of the heating chamber 2.

Meanwhile, the turn table vertical moving means 30 includes first and second slide rods 33 and 34 being respectively guided by first and second guide members 31 and 32 formed under the heating chamber 2 so as to support and simultaneously move the turn table 9 vertically.

The first and second slide rods 33 and 34 are coupled by hinges to first and second left link members 35*a* and 35*b* and first and second right link members 36*a* and 36*b* respectively so as to restrain vertically travelling distances of the first slide rod 33 and the second slide rod 34.

Furthermore, a hinge between the first left link member 35*a* and the second left link member 35*b*, and a hinge between the first right link member 36b and the second right link member 36*a* coupled to a horizontally-moving connection link member 37.

The hinge between the first right link member 36*a* and the second right link member 36*b* is hingedly coupled to a driving link member 38 in order to horizontally move the connection link member 37.

The driving link member 38 is mounted at the other end thereof to a worm wheel 40 having a cam 39 so as to convert rotary movement to reciprocating motion of the driving link member 38, where the worm wheel 40 is meshed to a worm 42 connected to a second motor 41.

Detecting means 50 is disposed at one side of the floor of the heating chamber 2 neighboring with the first guide member 31 so as to detect a position of the turn table 9.

In the turn table driving apparatus of the conventional microwave oven thus constructed, when manipulating means (not shown )is manipulated to drive the second motor 41, the second motor 41 serves to receive power to thereafter be driven and to rotate the worm 42 fixedly mounted to a motor axis (no reference numeral designated), which in turn serves to rotate the meshed worm wheel 40 and to operate the cam 39 integrally mounted to the worm wheel 40, so that the cam 39 can reciprocate the driving link member 38 hingedly coupled thereto.

At this time, the driving link member 38 serves to reciprocate the connection link member 37 hingedly mounted to one end thereof, whereby the connection link member 37 vertically folds and unfolds the first and second left link members 35*a* and 35*b* and the first and second right link member 36*a* and 36*b*.

When the first and the second left link members 35*a* and 35*b* and the first and the second right link members 36*a* and 36*b* are vertically folded and unfolded, the first slide rod 33 and the second slide rod 34 respectively hinge-coupled to upper ends of the first left link member 35*a* and the first right link member 36*a* are vertically moved to vertically move the turn table 9 disposed at an upper surface thereof so that the turn table 9 can be vertically adjusted to a predetermined height in the heating chamber 2.

At this time, because the driven coupling 23 disposed under the turn table 9 is keyed to the driving coupling 22, the driven coupling 23 is vertically moved, lengthwise while coupled to the driving coupling 22 when the first and the second slide rods 33 and 34 are vertically moved thereby moving the turn table 9.

Furthermore, when the turn table 9 is vertically moved to be positioned at the predetermined height in the heating chamber 2, the second motor 41 is stopped of its operation by control means (not shown) according to a detected signal from the detecting means 50 disposed at one side of the floor in the heating chamber 2, and the turn table 9 is rotated at the predetermined height by the first motor 21.

However, there is a problem in the turn table driving apparatus of the conventional microwave oven thus constructed, in that the structure thereof is complicated and breakdown thereof occurs often because the structure comprises a worm gear and complicated linkage driven thereby.

Furthermore, there is another problem in that frictional noise and abrasion can be generated because the plurality of slide rods 33 and 34 always contact bottom surface of the turn table.

SUMMARY OF THE INVENTION

Accordingly, the present invention is disclosed to solved the aforementioned problems and it is an object of the present invention to provide a turn table driving apparatus of a microwave oven by which a turn table axle is rotated according to a plurality of gears working in cooperation with a driven motor to thereby enable the turn table to rotate smoothly, and at the same time, to vertically move the turn table axle along a slanted track for vertical movement of the turn table.

It is another object of the present invention to provide a turn table driving apparatus of a microwave oven by which a structure thereof can be simplified and a number of parts thereof can be decreased to thereby reduce the manufacturing cost thereof.

It is still another object of the present invention to provide a turn table driving apparatus of a microwave oven by which a holder member supporting a turn table axle can be prolonged in life and at the same time, a smooth operation of the turn table axis is created to thereby reduce noise and vibration.

It is still another object of the present invention to provide a turn table driving apparatus of a microwave oven by which a turn table rotary motor and a turn table vertical moving motor can be mounted at opposite positions of a case to thereby enable a plurality of gears to be meshed smoothly and to improve an overall operational efficiency.

It is still another object of the present invention to provide a turn table driving apparatus of a microwave oven by which a turn table axle can be forcibly pulled down when not properly gravitating down due to unbalanced placement of food on the turn table, thereby leading to a smooth vertical movement of the turn table axis and preventing erroneous operation thereof in advance.

In accordance with an object of the present invention, there is provided a turn table driving apparatus of a microwave oven, the apparatus comprising:

- a turn table axle for vertically moving and rotating a turn table;
- a first motor for rotating the turn table axle;
- a pair of gears for being respectively mounted to and mutually meshed with the turn table axle and the first motor in order to rotate the turn table axle according to the driving of the first motor;
- a second motor for vertically moving the turn table axle; and
- a gear and a rotary cam for being respectively mounted to and mutually meshed with the second motor and the turn table axle in order to move the turn table axis vertically according to the driving of the second motor.

In accordance with another object of the present invention, there is provided a turn table driving apparatus of a microwave oven, the apparatus comprising:

- a turn table axle for rotating and vertically moving the turn table;
- a transmission gear for being fitted to the turn table axle so as to receive power from a power source to rotate the turn table axle;
- upper and lower journal members fitted on the turn table axle and disposed above and below the transmission gear; and
- a holder member for supporting the transmission gear and the upper and lower journal members.

In accordance with still another object of the present invention there is provided a turn table driving apparatus of a microwave oven, the apparatus for rotating and vertically moving the turn table comprising;

- a first motor disposed on a cover member in order to rotate a turn table axle coupled to the turn table;
- a second motor disposed on a base plate in an opposite direction from the first motor;
- a rotary cam disposed on the base plate so as to receive power from the second motor to vertically move the turn table axle; and
- a traction member disposed on the rotary cam in order to forcibly pull down the turn table axle when the turn table axle does not gravitate down due to an eccentric load applied thereto.

BRIEF DESCRIPTION OF THE DRAWINGS

For a fuller understanding of the nature and objects of the invention reference should be made to the following detailed description taken in conjunction with the accompanying drawings in which;

FIG. 3, 4 and 5 are drawings for illustrating a first embodiment of the present invention, where FIG. 3 is a plan view for illustrating a turn table driving apparatus according to the present invention and FIGS. 4 and 5 are longitudinal sectional views for illustrating a minimum position and a maximum position of a turn table axis each taken along line D—D in FIG. 3;

FIG. 6 is a perspective view for illustrating a coupling between a gear and the turn table axle shown in FIG. 3;

FIG. 7 is a longitudinal sectional view for illustrating a turn table driving apparatus according to the present invention and FIG. 8 is an enlarged sectional view of part E in FIG. 7 ;

FIG. 9 is an exploded perspective view of the second embodiment, FIG. 10 is a plan view of principal components of FIG. 9, FIG. 11 is a sectional view of FIG. 10, FIG. 12 is a plan view of principal parts for explaining an operation of the present invention.

FIG. 13 is a side view for illustrating how the turn table axis enters beneath a traction member, FIG. 14 is a side view for illustrating a state where the turn table axle is raised by a rotary cam, and FIG. 15 is a side view of principal parts for illustrating a state where the turn table axle is forcibly lowered by a traction member.

DETAILED DESCRIPTION OF PREFERRED EMBODIMENTS OF THE INVENTION

Figure 1:
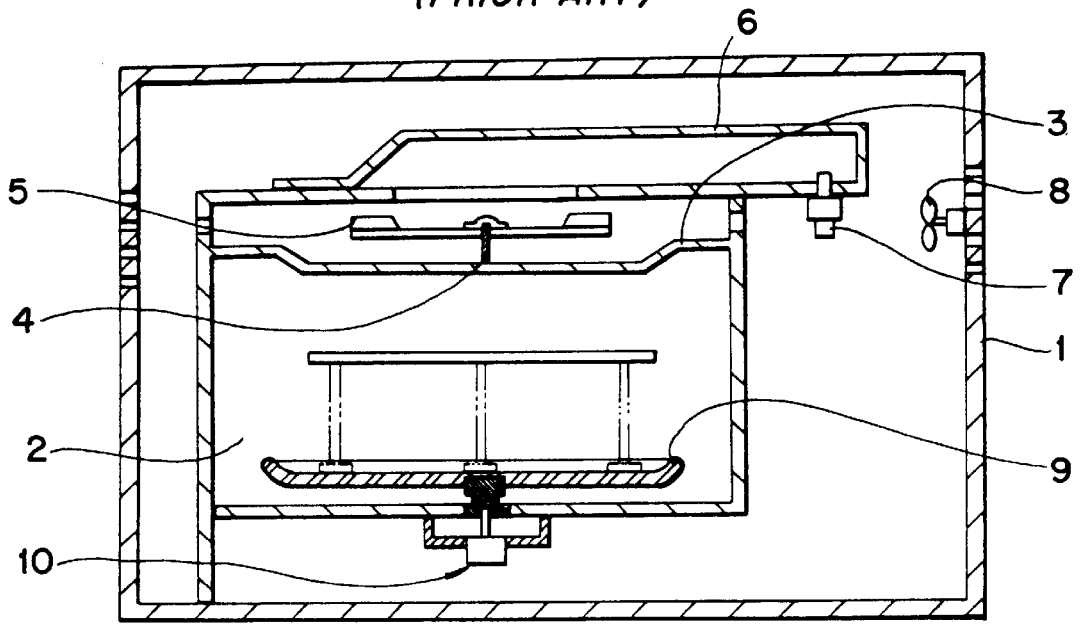
FIG. 1 (PRIOR ART)
FIG. 1 is a longitudinal sectional view for schematically illustrating a conventional microwave oven.
Figure 2:
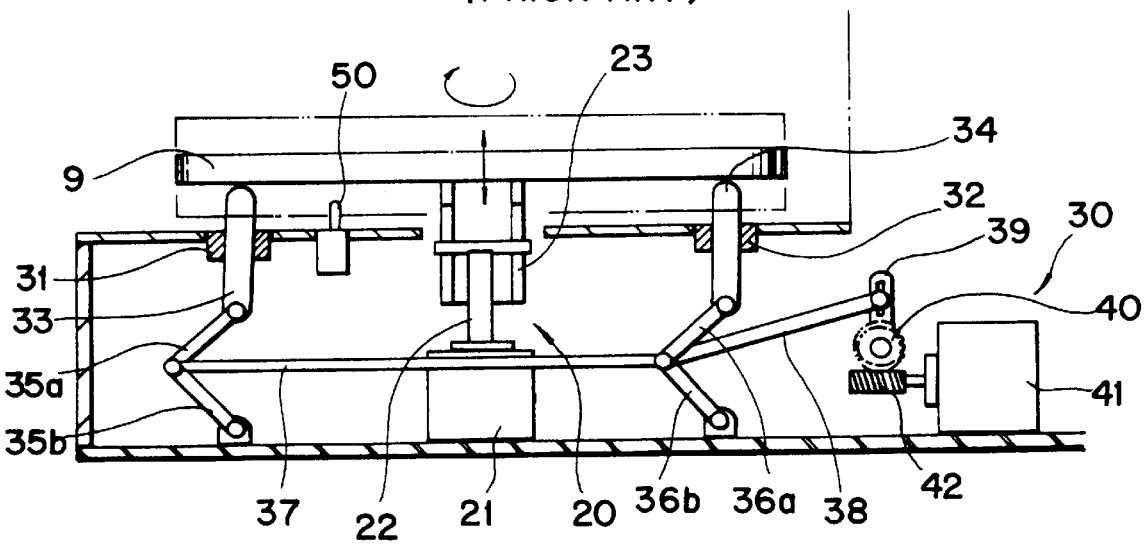
FIG. 2 (PRIOR ART)
FIG. 2 is a longitudinal sectional view for illustrating a conventional turn table driving apparatus.
Figure 3:
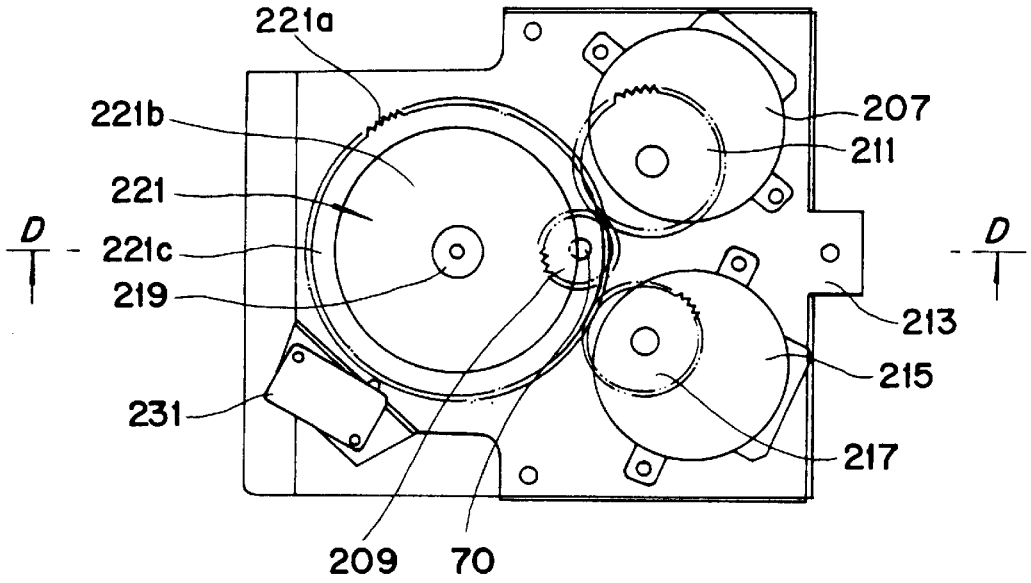
Figure 4:
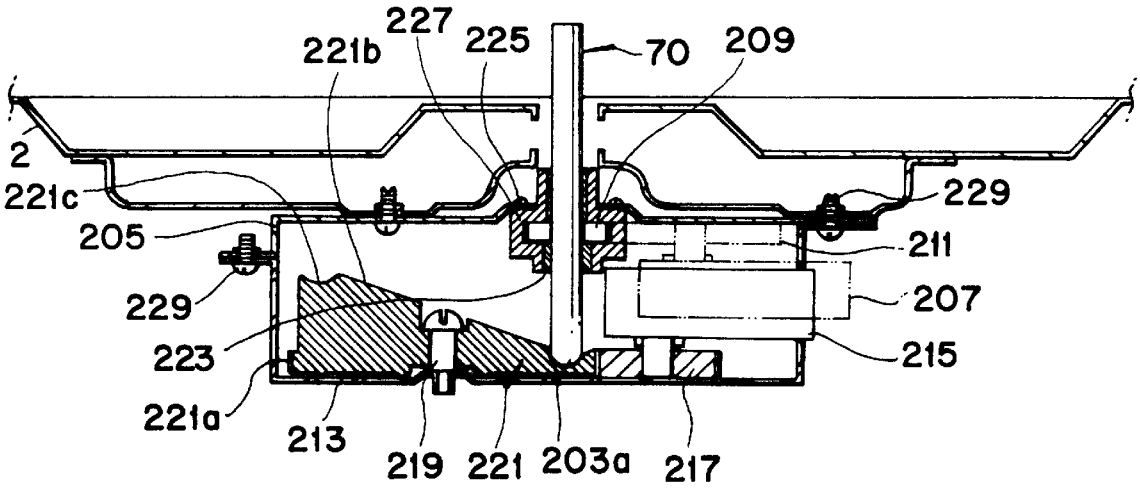

Now a first embodiment of the present invention will be described in detail with reference to FIGS. 3, 4, 5 and 6.

Throughout the drawings, like reference numerals and symbols are used for designation of like or equivalent parts or portions for simplicity of illustration and explanation, and detailed explanation thereof is omitted.

As shown in FIGS. 3, 4, 5 and 6, the heating chamber 2 is provided at a floor thereof with a turn table axle 70 for rotating the turn table 9 and a cover member 205 is provided at one side thereof with a first motor 207.

The turn table axle 70 is mounted to a gear 209 for rotating the turn table axle 70.

Furthermore, the first motor 207 is provided with a motor axis (no reference numeral designated) carrying a gear 211 for being meshed with the gear 209 to thereby rotate same.

A base plate 213 carries a second motor 215.

The second motor 215 is provided with a motor axis (no reference numeral designated) carrying a gear 217.

The base plate 213 carries a rotary cam 221 mounted by a fastening axle 219, so that it can be meshed with the gear to thereby move the turn table axle 70 vertically.

At this time, the turn table axle 70 is formed of cross sectional "D" shape so as to be rotatable with the gear 209, and is formed at one end thereof with a semi-spherical shape so as to make sliding point contact with a slant track of the rotary cam 221.

The turn table axle 70 is mounted in a bearing 223 to be smoothly rotated without being swayed and to be moved vertically.

The bearing 223 is supported by a holder member 227 coupled through the medium of a plurality of fastening member 225 to the cover member-205.

The gear 209 is formed with a through hole 209*a* having a larger "D" shape at an inner periphery thereof than the "D" shape at the outer periphery of the turn table axle so that the turn table axle 70 can be rotated and moved vertically.

The cover member 205 and the base plate 213 are provided with respective flange units (no reference numeral designated), so that the cover member 205 and the base plate 213 can be combined together by fastening members 229.

The rotary cam 221 is formed at a lower periphery thereof with gear teeth 221*a* meshed with the gear 217, and at an upper end thereof with a slant face 221*b* having a predetermined angle so that the turn table axle 70 can be vertically moved.

The slant face 221*b* is formed at an upper margin thereof with a slant track surface 221*c* of semi-circular cross sectional shape.

A sensor is disposed at one side of the base plate 213 to detect a position of the turn table axle 70 when same is lowered to a lowest level.

Now, vertical movement of the turn table axle 70 will be described according to the first embodiment of the present invention thus structured.

First, when the sensor 231 serves to detect the position where the turn table axle 70 is lowered to the lowest level in an initial waiting state, the second motor 215 rotates the gear 217 thereby rotating the rotary cam 221 meshed with the gear 217.

At this time, when the rotary cam 221 is rotated, the turn table axle 70 slides along the slant track surface 221*c* and performs vertical movements repeatedly.

Next, rotary operation of the turn table axle will be described.

When the first motor 207 is rotated, the gear 211 is rotated.

The gear 211 in turn rotates the gear 209 and at the same time, rotates the turn table axle, thereby causing the turn table 9 to rotate.

Accordingly, the turn table axle 70 is moved vertically along the slant track of the rotary cam 221 to thereby move the turn table 9 vertically and is rotated simultaneously according to the rotation of the gear 209.

As is apparent from the foregoing, there is an advantage in the turn table driving apparatus of a microwave oven according to the first embodiment of the present invention, in that the first and the second motor 207 and 215 are respectively mounted at one side to cause a driving force of the first motor 207 to be transferred to the gear 209 to rotate the turn table axle 70 and to rotate the turn table 9, whereby driving force of the second motor 215 is transferred to the rotary cam 221 to vertically move the turn table axle 70 along the slant track and to vertically move the turn table 9, so that the structure thereof can be simplified to reduce the number of parts and to save manufacturing cost.

Next, a second embodiment of the present invention will be described with reference to the accompanying FIGS. 7 and 8.

Throughout the drawings, like reference numerals and symbols as used in the first embodiment are used for designation of like or, equivalent parts or portions for simplicity of illustration and explanation and description thereto is omitted accordingly.

Figure 7:
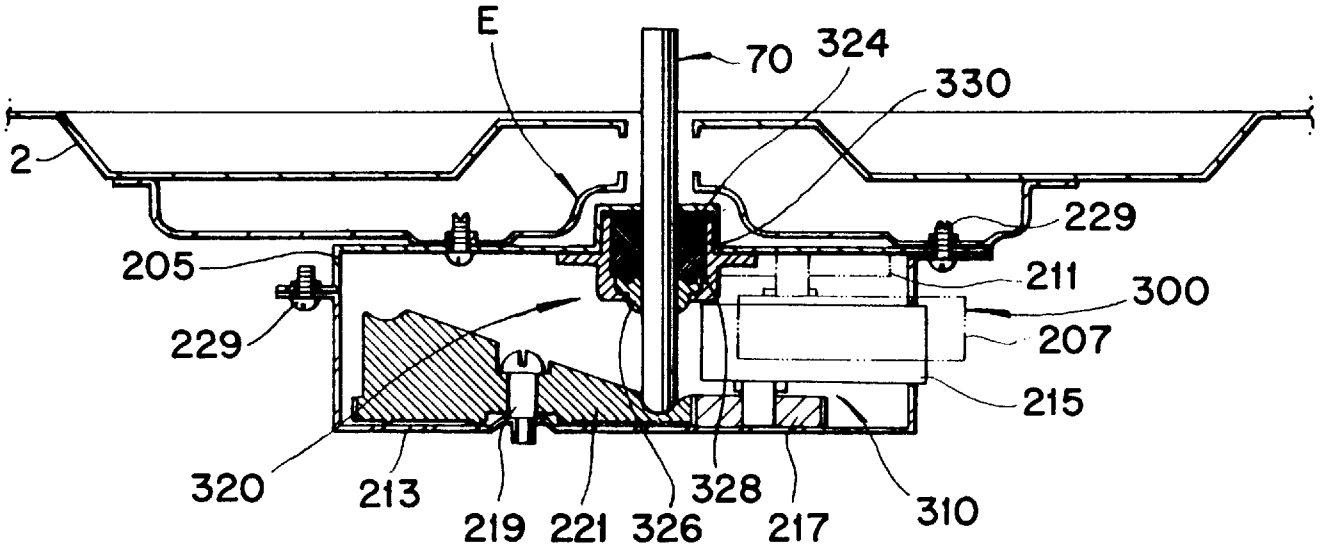
FIG. 7 and 8 are schematic diagrams of a second embodiment according to the present invention, where
Figure 8:
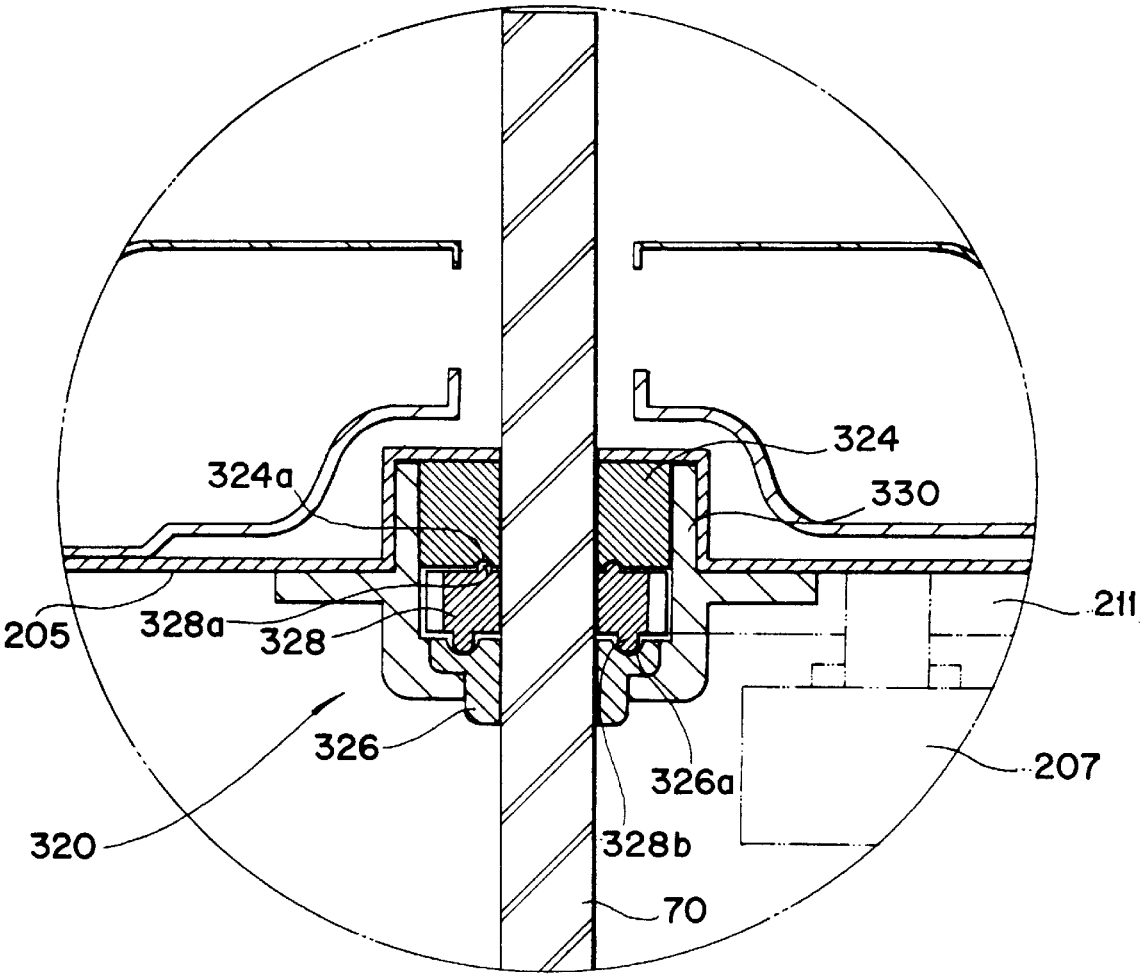
Figure 9:
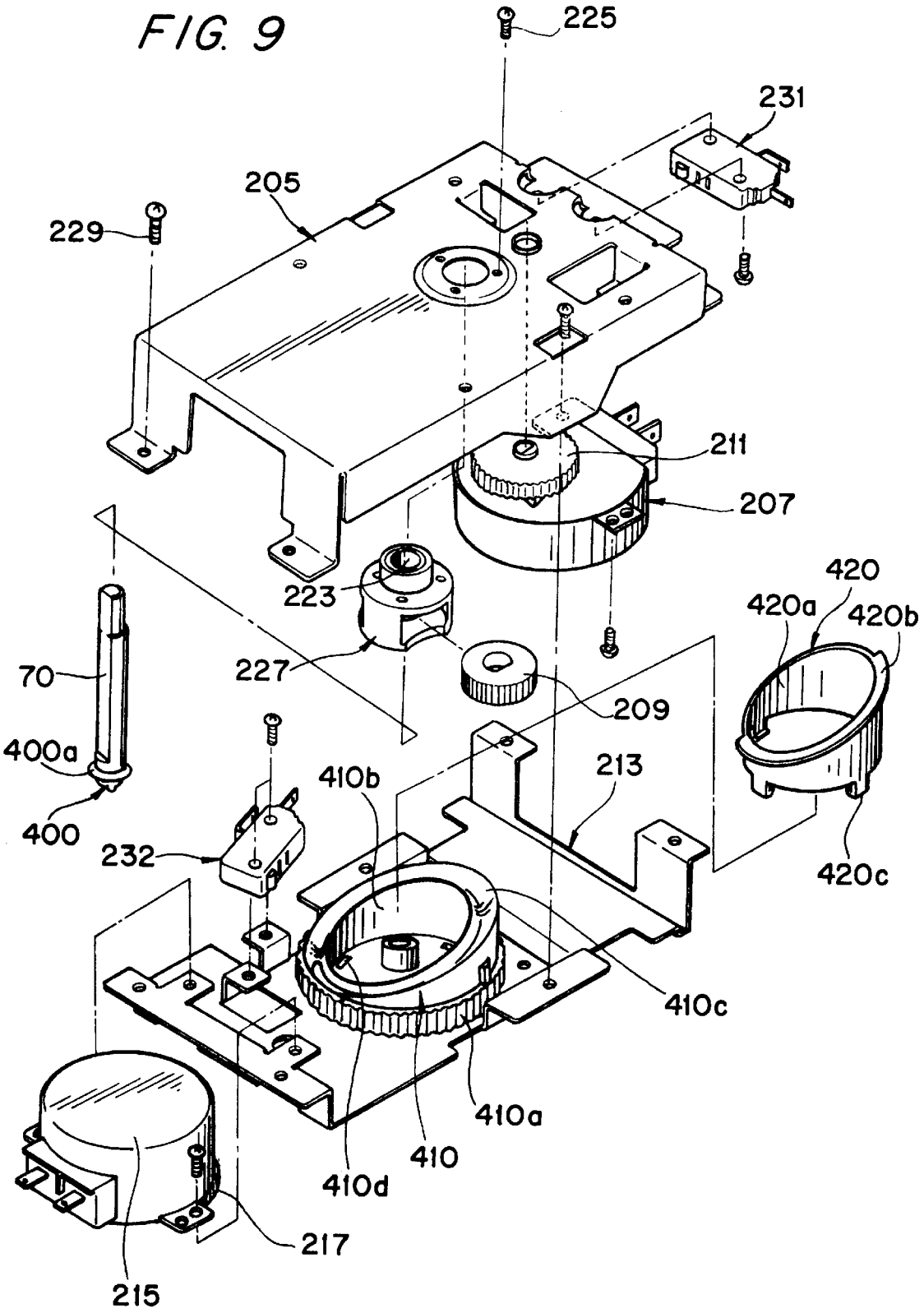
FIGS. 9–15 are schematic diagrams for illustrating a third embodiment of the present invention, where
Figure 10:
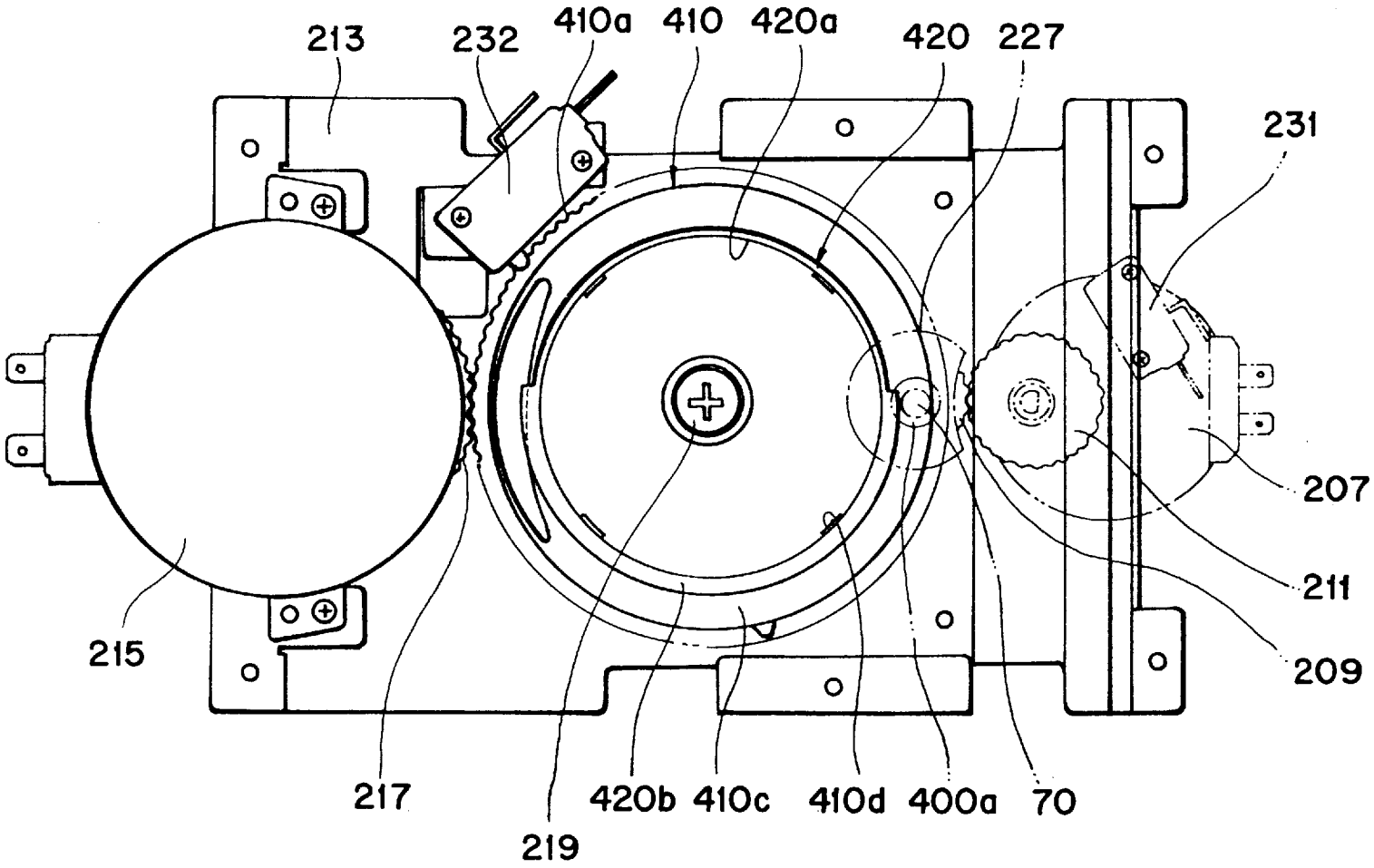
Figure 11:
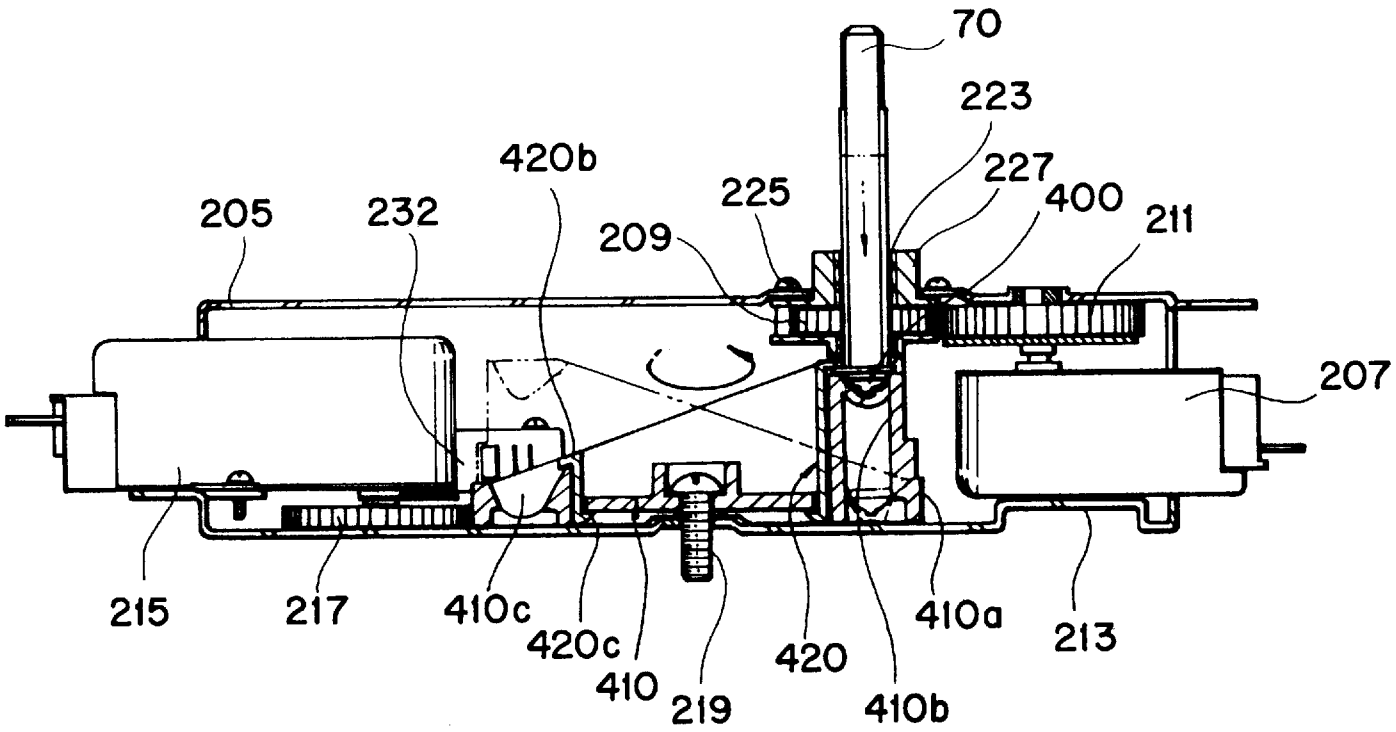

As illustrated in FIGS. 7 and 8, turn table rotary means 300 is situated in a space existing between a cover member 205 and a base plate 213 and is mounted to the cover member 205. A turn table vertical moving means 310 also located in the space and is mounted to the base plate 213.

Power transmission means 320 is positioned in the space and is mounted to the cover member 205.

The power transmission means 320 has upper and lower journal members 324 and 326 coupled to an external peripheral surface of the turn table axle 70.

The turn table axle 70 is coupled to the space between the upper journal member 324 and the lower journal member 326.

The upper and lower journal members 324 and 326 are coupled at peripheral surfaces thereof to a holder member 330 which is in turn connected to the cover member 205.

At this time, the upper and lower journal members 324 and 326 are centrally formed with through holes (no reference numeral designated) so as to receive a "D" shaped peripheral surface of the turn table axle 70 which slides within the journal members.

The lower journal member 326 is formed at an upper surface thereof with a ring-shaped groove 326*a*.

Furthermore, the upper and lower journal members 324 and 326 are made of plastic or metal coated by teflon.

Meanwhile, the transmission gear 328 is made such that an inner peripheral surface of "D" shape centrally formed thereon receives the outer peripheral surface of "D" shape of the turn table axle 70, and an outer peripheral surface of gear 328 is meshed with the gear 211 coupled to the motor axis (no reference numeral designated) of the first motor 207.

At this time, an underside of the transmission gear 328 is formed with a ring-shaped protrusion inserted into a groove 326*a* formed in an upper side of the lower journal member 326.

A portion of the outer periphery of the holder member 330 is cut open so as to rotatatively accommodate meshing of the transmission gear 328 with the gear 211.

In the turn table driving apparatus of a microwave oven according to the second embodiment of the present invention thus constructed, when the first motor 207 is activated, the gear 211 coupled to the motor axis of the first motor 207 is rotated, and the gear 211 in turn rotates the transmission gear 328 relative to the journals 324, 326 to thereby rotate the turn table axle 70 and the turn table 9.

Furthermore, the journal members 324, 326 serve to perform a guide function by guiding vertical movement of the axle 70 and rotation of the axle 70 and the gear 328.

As is apparent from the foregoing, there is an advantage in the turn table driving apparatus of a microwave oven according to the second embodiment of the present invention, in that the life of the holder member 330 can be extended and a smooth operation of the turn table axle 70 can reduce noise and vibration, because, when the rotary and vertically moving functions of the turn table axle 70 are performed independently, abrasion of the holder member 330 is reduced by the upper and lower journal members 324 and 326.

Next, a third embodiment of the present invention will be described with reference to the accompanying FIGS. 9–15.

Throughout the drawings, like reference numerals and symbols are used for designation of like or equivalent parts or portions for simplicity of illustration and explanation, and descriptions thereof are omitted.

In the drawings from FIG. 9 through FIG. 15, a turn table axle 70 for rotating a turn table 9 is coupled to a floor of a heating chamber 2, and a first motor 207 is disposed at one side of a cover member 205 in order to receive power and thereafter to be activated.

A gear 209 is coupled to an outer periphery of the turn table axle 70 in order to rotate same.

Furthermore, a gear 211 is coupled to a motor axle (no reference numeral designated) of the first motor 207 in order to rotate the gear 209 by being meshed thereto.

A second motor 215 is symmetrically disposed from the first motor 207 at an opposite side of a base plate 213 so as to be driven by received power.

A gear 217 is coupled to a motor axle (no reference numeral designated of the second motor 215 so as to be driven thereby.

A rotary cam 410 is rotatatively mounted on the base plate 213 by way of a fastening axle 219 so as to vertically move the turn table axle 70 when driven by the gear 217.

At this time, a shaft portion of the turn table axle 70 is formed with a cross-sectional "D" shape so that a predetermined portion at a peripheral surface thereof can be cooperatively operated according to the rotation of the gear 209.

A peripheral surface of the "D" shape is guided in a holder member 227 so that the turn table axle 70 can be smoothly rotated without any sway and can be vertically moved.

The holder member 227 is mounted to a bottom surface of the cover member 205 by a plurality of fastening members 225, and at an inner peripheral surface thereof is coupled to a bearing 223 so that the turn table axle 70 can be smoothly rotated and vertically moved.

Furthermore, a bottom end of the turn table axle 70 includes a plastic semi-spherical contact member 400 fused to the lower end of the shaft portion of the axle. The lower end of the contact member is convexly curved and easily slides along a slant track surface of the rotary cam 410 by way of point contact to prevent the rotary cam 410 from being abraded.

At this time, the contact member 400, has an integral tripping jaw 400*a* having a larger outer diameter than that of the turn table axle 70 so that the turn table axle 70 can be forcibly lowered by tractive operation of a traction member (described later).

The gear 209 is centrally formed with a through hole 209*a* having a larger "D" shaped inner peripheral surface than the "D" shaped peripheral surface of the turn table axle 70 so that the turn table axle 70 can be rotated and vertically moved.

The cover member 205 and the base plate 213 are respectively, integrally, outwardly and foldingly formed with flange units (no reference numeral designated) so that the cover member 205 and the base plate 213 can be coupled together by fastening members 229.

The rotary cam 410 is formed at a lower peripheral surface thereof with gear teeth 410*a* so that the gear 217 can be meshed thereto.

The rotary cam 410 includes a generally ring-shaped slant wall 410*b* having an upper end inclined at a predetermined angle relative to horizontal (see FIG. 11) so as to vertically move the turn table axle 70.

That upper end of the slant wall 410*b* is formed as an upwardly facing concaved semi-spherical slant track surface 410*c* so that, when the rotary cam 410 is rotated, the turn table axle 70 can be vertically moved by the surface 410*c* which is always in contact with the contact member 400 at the lower end of the turn table axle 70.

The cam 410 has a flat upper edge area formed with a plurality of grooves 410*d* so that a traction member (described later) can be coupled to the cam 410 by an elastic snap-in force.

Furthermore, the rotary cam 410 is coupled to a traction member 420 which can forcibly lower the turn table axle 70 when the turn table axle 70 cannot be lowered due to an eccentric load being applied thereto.

In other words, the traction member 420 is formed with a ring-shaped body 420*a* which can be inserted through an upper area of the rotary can 410 to thereby be positioned adjacent an inner periphery of the slant wall 410*b*.

The body 420*a* is formed at an upper peripheral end thereof with a radially-outwardly projecting half ring-shaped traction jaw 420*b* oriented at the same angle to horizontal as the surface 410*c* and extending thereover at a vertical distance therefrom, for tracking the tripping jaw 400*a* of the contact member 400, so that the turn table axle 70 can be forcibly lowered when the cam 410 is rotated.

The body 420*a* is formed at a predetermined bottom periphery thereof with a plurality of fixed hook-shaped protrusions 420*c* (FIG. 14) which can be resiliently inserted into the plurality of grooves 410*b* formed in a flattened area of the rotary cam 410, thereby causing the traction member 420 to be coupled to the rotary cam 410.

Figure 12:
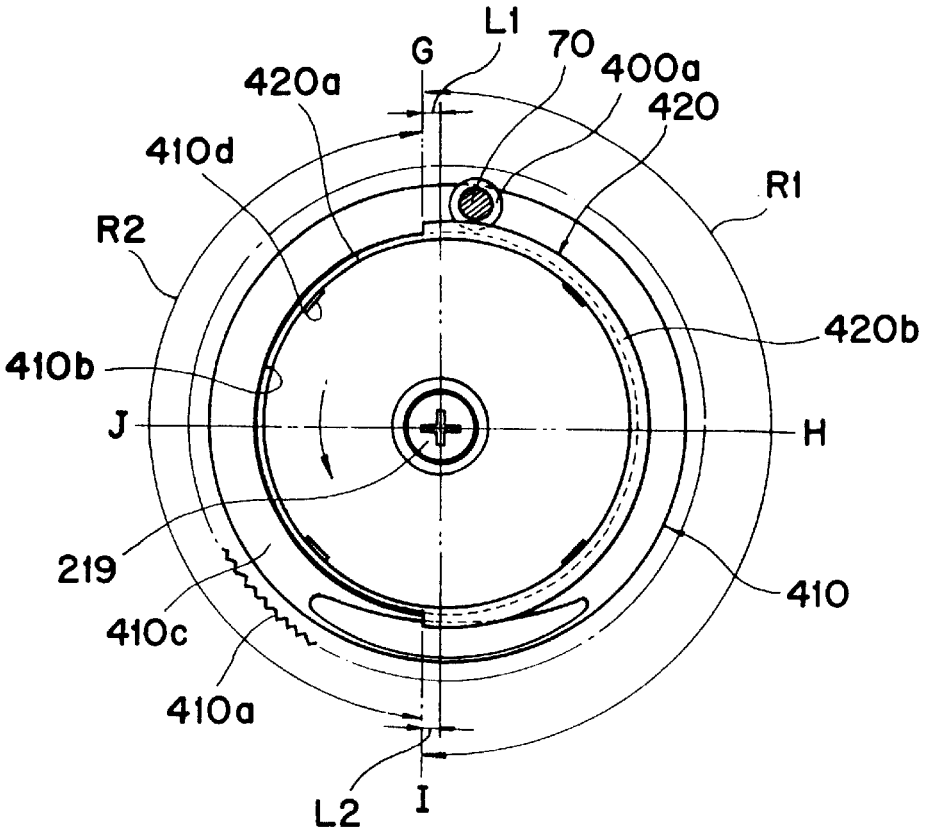

The traction jaw 420*b* extends above the portion of the surface 410*c* which causes the axle 70 to descend, so that the tripping jaw 400*a* of the contact member 400 can be pressed downward when the turn table axle 70 is lowered by the rotation of the rotary cam 410, as illustrated in FIG. 12.

In other words, the traction jaw 420*b* overlies a turn table axle descent region (R1) of the surface 410*c*, and the traction jaw 420*b* extends for more than 180 degrees (as viewed from above in FIG. 12). That is, the traction jaw is formed at both ends thereof with extension units (L1) and (L2) of predetermined lengths in order to be longer than a turn table axle ascent region (R2). The extension unit (L1) has its entry portion 420*e* (FIGS. 9–13) bent at a predetermined upward angle, so that tripping jaw 400*a* of the contact member 400 can be easily entered into the turn table axle descent region (R1)

Reference numeral 231 in the drawing represents a first sensor disposed on one side of the base plate 213 in order to detect a position of the turn table axle 70 when it descends to a lowest position, and reference numeral 232 denotes a second sensor disposed on one side of the cover member 205 in order to control the first motor 207 by being tripped by a projection (no reference numeral designated) located at a predetermined position on the gear 211 when the gear 211 is rotated.

Now, the vertical motion of the turn table axle 70 will be described in the turn table driving apparatus of a microwave oven according to the third embodiment of the present invention thus constructed.

First of all, when the first sensor 231 detects that the turn table axle 70 has descended to the lowest position in an initial wait (rest) state, a motor axle (no reference numeral designated) is rotated by the second motor 215, and the gear 217 is rotated by the motor axis, thereby rotating the rotary cam 410 meshed with the gear 217. The cam 410 rotates clockwise in FIG. 12.

At this time, when the rotary cam 410 is rotated, the semi-spherical surface of the contact member 400 of the turn table axle 70 slides in point contact with the semi-spherical slant track surface 410*c* and descends or ascends.

In other words, the turn table axle 70 descends from a highest to a lowest position when sections G, H and I of the cam descent region (R1) pass thereunder sequentially, and the turn table axle 70 ascends from the lowest to a highest level when sections I, J and G of the cam ascent region (R2) pass thereunder sequentially.

Figure 13:
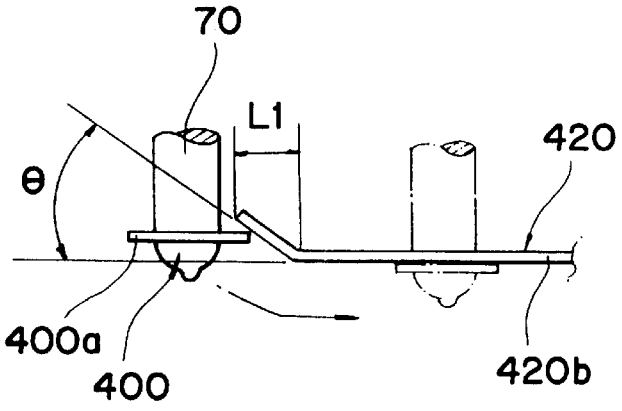
Figure 14:
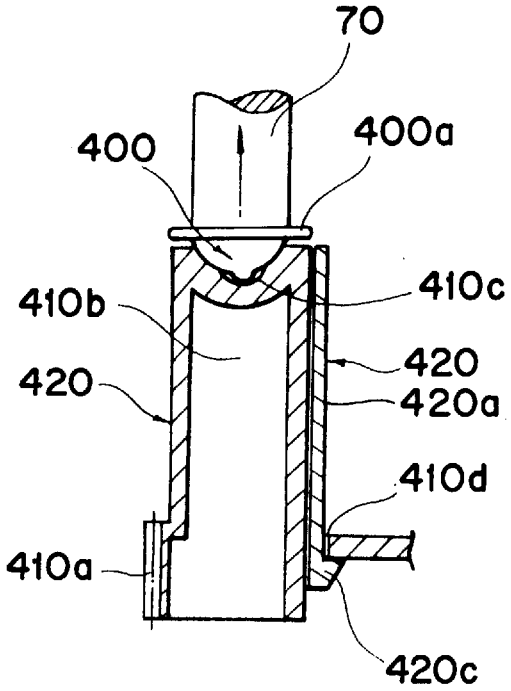

At this time, when section G of the slant track surface 410*b* passes under the turn table axle 70 as illustrated in FIG. 13, the tripping jaw 400*a* of the turn table axle 70 easily enters the space between the traction jaw 420*b* and the slant track surface 410*c* due to the bent entry portion 420*e* of the traction jaw 420*b*.

Figure 15:
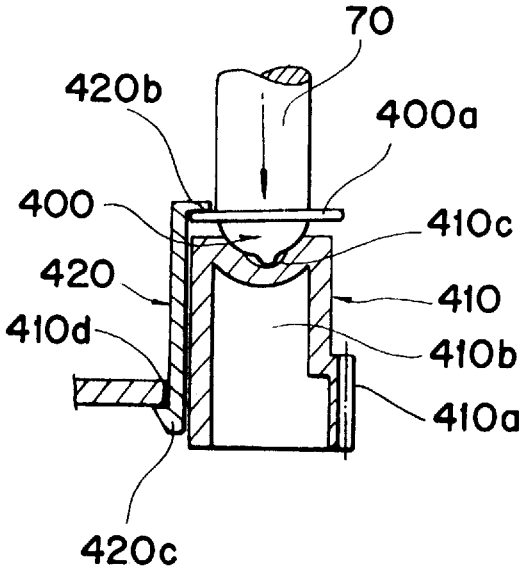

The turn table axle 70 having entered between the traction jaw 420*b* and the slant track surface 410*c* is forcibly lowered when engaging the turn table axle region (R1), as illustrated in FIG. 15 so that the presence of an eccentric load on the turn table axle 70 caused by an unbalanced position of food on the turn table cannot result in the axle 70 becoming frictionally stuck within the bearing 223.

Meanwhile, when the turn table axle 70 engages the turn table axis ascent region (R2), the turn table the axle 70 is raised without any interference from the traction member 420 and forcibly performs ascending operation.

At this time, position control according to height of the turn table axle 70 is realized by revolution control of the second motor 215.

Next, rotary operation of the turn table axle 70 will be described.

When the first motor 207 is rotated, the gear 211 is rotated to thereby rotate the gear 209.

The gear 209 rotates the turn table axle 70 to thereby rotate the turn table 9 coupled to an upper and of the turn table axle 70.

Accordingly, the turn table axle 70 descends or ascends along the slant track surface 410*c* of the rotary cam 410, and at the same time, is rotated by the gear 209, so that a three-dimensional motion where,the turn table 9 is lowered, raised and rotated is performed.

As is apparent from the foregoing, there is an advantage in the turn table driving apparatus of a microwave oven according to the third embodiment of the present invention, in that the first and second motors 205 and 215 are symmetrically disposed on opposite sides of the rotary cam. The driving force of the first motor 207 is transmitted to the gear 209 to rotate the turn table axle 70 and the turn table 9, and a driving force of the second motor 215 is transmitted to the rotary cam 410 to raise or lower the turn table axle 70 along the slant track surface 410*c* to thereby move the turn table 9 vertically. The structure is simple and the number of parts involved can be reduced, thereby reducing the manufacturing cost thereof, Furthermore, there is another advantage in that, when the first motor 207 is assembled to the cover member 205 the gear 211 and the gear 209 are caused to be meshed together and, when the second motor 215 is assembled to the base plate 213, the gear 217, and the rotary cam 410 are caused to be meshed together. Also, when the cover member 205 and the base plate 213 are assembled by a plurality of fastening members 400, the turn table axle 70 sits on a properly inclined slant track surface 410*c* of the rotary cam 410, so that operation processes involved for gear setting are eliminated to thereby improve operational efficiency.

Still furthermore, there is still another advantage in that the present invention is structured such that the rotary cam 410 is provided with the traction member 420 in order to forcibly lower the turn table axle 70 which might not otherwise properly descend due to an eccentric load applied to the turn table by an unbalanced position of food.

What is claimed is:

1. A microwave oven comprising:

a cooking chamber;

a microwave generator for supplying microwave to the cooking chamber;

a food-supporting device including a turn table disposed in the cooking chamber, and an axle extending downwardly therefrom and out of the cooking chamber;

a driving system disposed below the cooking chamber for rotating the turn table about a vertical first axis and for moving the turn table vertically, the drive mechanism including:

a rotary cam rotatable about a vertical second axis oriented parallel to the first axis and an upwardly facing track surface on which a lower portion of the axle rests, the track surface configured for causing the axle and turn table to move alternately in upward and downward directions in response to rotation of the rotary cam, the cam including a traction member rotatable therewith and spaced above the track surface, the traction member overlying a portion of the axle for ensuring that the axle moves in the downward direction; and a motorized mechanism for rotating the axle and turn table about the first axis, and for rotating the rotary cam about the second axis.

2. The microwave oven according to claim 1 wherein the lower end of the axle is convexly curved and makes substantially point contact with the track surface.

3. The microwave oven according to claim 2 wherein the track surface is concavely curved when viewed in cross section.

4. The microwave oven according to claim 2 wherein the axle includes a shaft portion and a plastic contact member mounted on a lower end thereof and carrying the convexly curved surface.

5. The microwave oven according to claim 1 wherein the axle includes a radially outwardly projecting tripping jaw spaced above the lower end of the axle, the tripping jaw extending beneath the traction member.

6. The microwave oven according to claim 1 wherein the rotary cam comprises a hollow vertical wall, said track disposed on an upper end of the wall, the tripping member being mounted inside of the wall.

7. The microwave oven according to claim 6 wherein the rotary cam includes a lower portion having an upwardly facing surface forming a floor of a hollow portion of the vertical wall, the floor including grooves formed therein, the traction member including downwardly projecting hooks configured to snap into the respective ones of the grooves.

8. The microwave oven according to claim 6 wherein the rotary cam includes gear teeth projecting from an outer periphery thereof for receiving a rotary drive force from the motorized mechanism.

9. The microwave oven according to claim 1 wherein the track surface is annular and lies in a plane inclined an acute angle relative to a horizontal plane, the track surface including a single high point and a single low point spaced apart by 180° whereby a first portion of the track surface extending between the low and high points causes the axle to be raised, and a second portion of the track surface extending between the low and light points causes the axle to be lowered.

10. The microwave oven according to claim 9 wherein the traction member extends more than 180° and less than 360° and extends along the entire second portion of the track surface.

11. The microwave oven according to claim 10 wherein an end of the traction member beneath which the axle passes during rotation of the rotary cam is bent upwardly.

12. The microwave oven according to claim 1 wherein the drive mechanism includes first and second motors disposed substantially diagonally apart with reference to the second axis, the first motor operably connected to the axle for rotating the axle, and the second motor operably connected to the rotary cam for rotating the rotary cam.

13. A microwave oven comprising:

a cooking chamber, a microwave generator for supplying microwaves to the cooking chamber;

a food-supporting device including a turn table disposed in the cooking chamber, and an axle extending downwardly therefrom and out of the cooking chamber;

a driving system disposed below the cooking chamber for rotating the turn table about a vertical first axis and for moving the turn table vertically, the drive mechanism including:

a rotary cam rotatable about a vertical second axis oriented parallel to the first axis and including an upwardly facing track surface on which a lower portion of the axle rests, the track surface configured for causing the axle and turn table to move alternately in upward and downward directions in response to rotation of the rotary cam, the cam including a traction member rotatable therewith and spaced above the track surface, the traction member overlying a portion of the axle for ensuring that the axle moves in the downward direction;

first and second motors;

a first pair of gears fixed to the first motor and the axle, respectively, for rotating the axle about the first axis, and a second pair of gears fixed to the rotary cam and second motor, respectively, for rotating the rotary cam.

14. The microwave oven according to claim 13 wherein the first and second motors are spaced apart by generally 180° with reference to the second axis.

* * * * *